US007530882B2

(12) United States Patent
Soma et al.

(10) Patent No.: US 7,530,882 B2
(45) Date of Patent: May 12, 2009

(54) GRINDING METHOD AND GRINDING MACHINE

(75) Inventors: Shinji Soma, Handa (JP); Hiroshi Morita, Hoi-gun (JP)

(73) Assignee: JTEKT Corporation, Osaka-shi (JP)

( * ) Notice: Subject to any disclaimer, the term of this patent is extended or adjusted under 35 U.S.C. 154(b) by 0 days.

(21) Appl. No.: 11/688,990

(22) Filed: Mar. 21, 2007

(65) Prior Publication Data

US 2007/0232192 A1 Oct. 4, 2007

(30) Foreign Application Priority Data

Mar. 31, 2006 (JP) ..... 2006-098054

(51) Int. Cl.
*B24B 49/00* (2006.01)

(52) U.S. Cl. ..... 451/11; 451/57

(58) Field of Classification Search ..... 451/5, 451/11, 49, 57, 246, 249
See application file for complete search history.

(56) References Cited

U.S. PATENT DOCUMENTS 4,603,514 A 8/1986 Suzuki et al.
4,625,461 A * 12/1986 Vetter ..... 451/11
6,409,573 B1 * 6/2002 Mukai et al. ..... 451/5
6,878,043 B1 * 4/2005 Junker ..... 451/49
7,118,453 B2 10/2006 Hori et al.
2005/0026548 A1 * 2/2005 Mavro-Michaelis ..... 451/5

FOREIGN PATENT DOCUMENTS

JP 55-137865 10/1980
JP 2001-269865 10/2001
JP 2005-324313 11/2005

* cited by examiner

*Primary Examiner*—Jacob K Ackun, Jr.
(74) *Attorney, Agent, or Firm*—Oblon, Spivak, McClelland, Maier & Neustadt, P.C.

(57) ABSTRACT

A grinding method of a rotating workpiece W having a cylindrical part 20 and a pair of end faces 21 at both sides of the cylindrical part 20 uses a grinding wheel 10 whose grinding stone is narrower than a finishing width S1 between the end faces 21. In a first grinding step, the grinding wheel 10 is relatively moved to the cylindrical part 20 in a direction crossing the rotational axis of the workpiece W and is shuttled along the rotational axis of the workpiece W at least one time between the finishing width S1 of the end faces 21 until the grinding wheel 10 reaches the cylindrical part. And in a second grinding step, the grinding wheel 10 is moved from one of the end faces 21 to the opposite end face 21 on the cylindrical part 20, so as to finish the end faces 21 to a predetermined width S1.

4 Claims, 6 Drawing Sheets

GRINDING METHOD AND GRINDING MACHINE

INCORPORATION BY REFERENCE

The present application claims priority under 35 U.S.C. §119 to Japanese Patent Application No. 2006-098054, filed on Mar. 31, 2006. The contents of that application are incorporated herein by reference in their entirety.

BACKGROUND OF THE INVENTION

1. Field of the Invention

This invention relates to a grinding method and a grinding machine to grind a workpiece which has end faces at both sides of a cylindrical part.

2. Discussion of the Background

It is well-known that a workpiece W, e.g., a crankshaft, has a cylindrical part 51, a pair of end faces 52 at both sides of the cylindrical part 51 and R-parts 53 connecting the cylindrical part 51 with the end faces 52. FIG. 6(*a*) shows a conventional grinding method of the workpiece W whose rotational axis is parallel to the rotational axis of a grinding wheel 50. A grinding stone of the grinding wheel 50 is formed into a shape corresponding to the finished shape of the cylindrical part 51, end faces 52 and R-parts 53 of the workpiece W by truing. According to the method, a single plunge grinding step completes grinding the cylindrical part 51, end faces 52 and R-parts 53 so as to reduce a grinding time. However, a grinding amount per unit area is larger between the sides (edges) of the grinding stone of the grinding wheel 50 and the R-parts than at a circumference of the grinding stone, so that the end faces 52 of the workpiece W are heated up and tend to obtain a grinding burn. As to the formed grinding wheel 50, because of the large grinding amount around the edges, the edges partially wear off as shown in FIG. 6(*b*). Although the grinding stone of the grinding wheel 50 is modified by the truing, the width of the grinding stone is set equal to the finishing width between the end faces 52 so that the sides of the grinding stone are not trued. The reason is that truing the sides make the grinding stone of the grinding wheel 50 thinner, so that one plunge grinding process cannot create the finishing width between the end faces 52. Therefore, the grinding stone of the grinding wheel 50 is modified by truing on the circumference and the R-parts toward the two-dot chain line shown in FIG. 6(*b*), which eliminates a large amount of the grind stone. This results in poor productivity with respect to the number of workpieces W to be ground per grinding wheel 50.

Japanese patent application publication No. 2005-324313 discloses another grinding method with a grinding wheel whose grinding stone is thinner than the width between the end faces. The method has a first grinding step in which the grinding wheel is fed to one of the end faces while moving obliquely toward the other end face so as to grind conically, and a second grinding step in which the grinding wheel traverses to the one end face parallel to the rotational axis of the workpiece and then retracts vertically so as to eliminate the cone and finish the end face. According to this method, however, at least two plunge grinding steps are required, so that the grinding time becomes long. Additionally, because the grinding width is large in the beginning of the grinding, as is the grinding volume, the workpiece is heated up and expanded, resulting in poor precision.

Further prior art is disclosed in Japanese patent application publication No. 55-137865. This discloses a so-called an angular grinding machine whose grinding wheel rotates about a rotational axis inclining to the rotational axis of the workpiece. The grinding wheel of the angular grinding machine has a cylindrical grinding portion and a face grinding portion, so that the cylindrical part and end face of the workpiece are ground by alternately feeding the workpiece in the direction of its rotational axis and the grinding wheel in the direction of the inclination to the rotational axis of the grinding wheel. The angular grinding machine, however, is able to grind only one of the end faces unless the workpiece is reversed, whereby the grinding time is increased. Or, depending on the width and depth of the pair of the end faces, the grinding wheel is not able to be fed into the intermediate part of the end faces.

SUMMARY OF THE INVENTION

According to the invention, in a grinding method of a rotating workpiece having a cylindrical part and a pair of end faces at both sides of the cylindrical part with a grinding wheel whose grinding stone is narrower than a finishing width between the end faces, the grinding wheel rotates about a rotational axis parallel to a rotational axis of the workpiece and relatively moves to the workpiece. The grinding method comprises steps of feeding the grinding wheel relatively to the cylindrical part in a direction crossing the rotational axis of the workpiece and shuttling the grinding wheel along the rotational axis of the workpiece at least one time between the finishing width of the end faces until the grinding wheel reaches the cylindrical part, and traversing the grinding wheel from one of the end faces to the opposite end face on the cylindrical part, so as to finish at least the end faces to a predetermined width.

According to the invention, a grinding machine to grind a workpiece having a cylindrical part and a pair of end faces at both sides of the cylindrical part with a grinding stone of a grinding wheel in a predetermined finishing width between the end faces comprises a head stock to support the workpiece rotatably, a wheel head to support the grinding wheel rotatably, drive units to move the head stock and the wheel head relatively parallel to and perpendicular to the rotational axis of the workpiece, and a controller to move the grinding wheel to the cylindrical part and shuttle the grinding wheel at least one time between the finishing width of the end faces in a first grinding step, and to move the grinding wheel from one of the end faces to the opposite end face on the cylindrical part in a second grinding step.

BRIEF DESCRIPTION OF THE DRAWINGS

Various objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Figure 1:
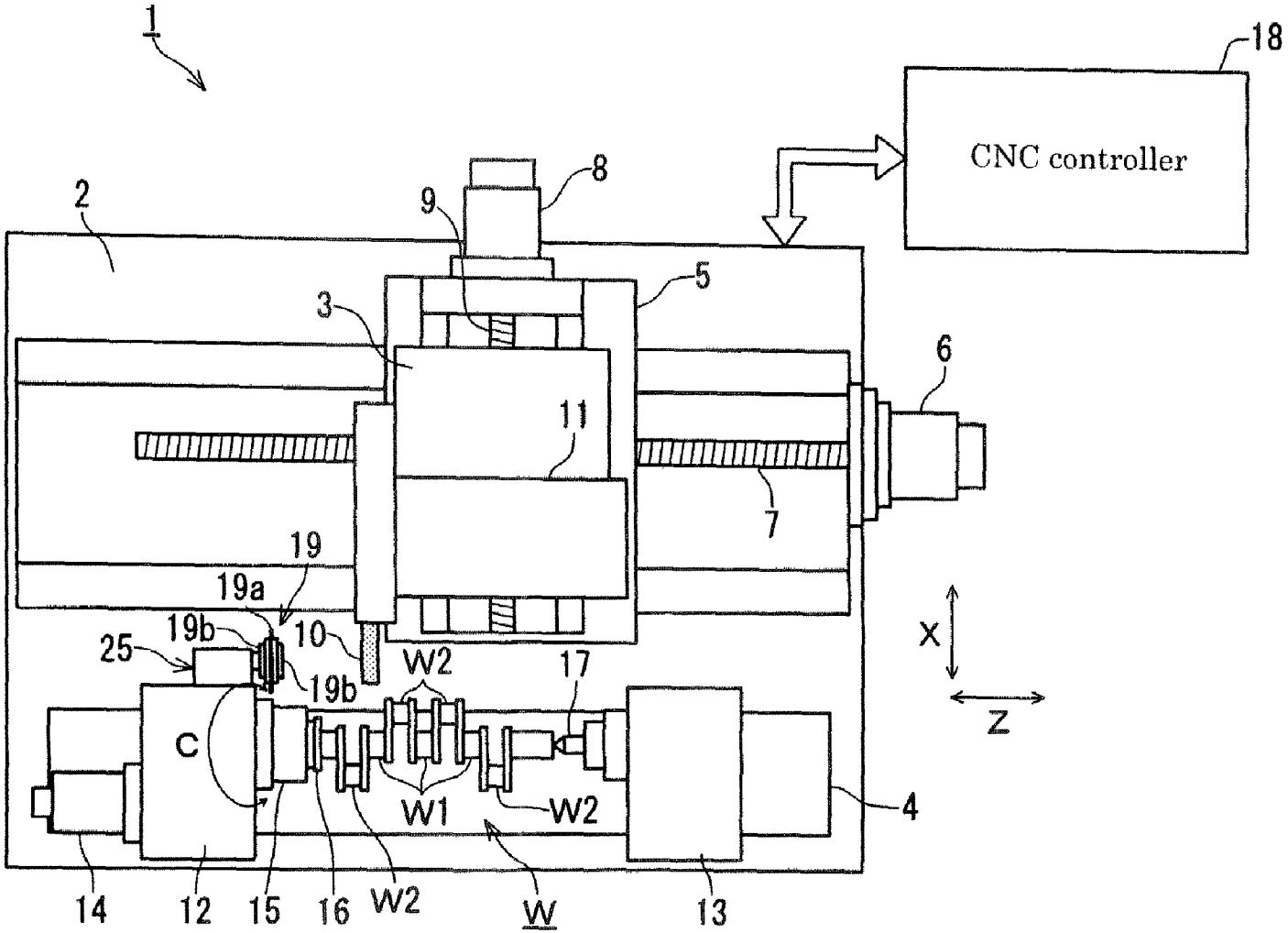
FIG. 1 is a schematic plan view of a cylindrical grinding machine of a first embodiment related to the invention.

A first embodiment of a grinding method and a grinding machine related to the present invention will be described with reference to FIGS. 1 to 4. FIG. 1 shows a schematic plan view of a cylindrical grinding machine 1 of which C- and X-axes are synchronously controlled. The grinding machine 1 comprises a bed 2, a wheel head 3 movably disposed on the bed 2 and a table 4 disposed on the bed 2 to support a shaft-like workpiece W. Between the bed 2 and the wheel head 3, a saddle 5 is movably arranged to move along a Z-axis parallel to an axial direction of the workpiece W. The wheel head 3 is movably arranged on the saddle 5 to move along the X-axis which corresponds to the radial direction of the workpiece W.

The saddle 5 is moved toward the Z-axis via a Z-axis drive train 7, e.g., a ball screw mechanism, by a Z-axis drive unit 6 which is able to index rotational angles, e.g., a servo motor. The wheel head 3 is moved toward the X-axis via an X-axis drive train 9, e.g., a ball screw, by an X-axis drive unit 8 which is able to index rotational angles, e.g., a servo motor. Therefore the wheel head 3 is moved toward the X- and Z-axes relative to the table 4. And the wheel head 3 has a grinding wheel drive unit 11, e.g., an electric motor, so as to rotatably support a disk-like grinding wheel 10.

The table 4 has a head stock 12 on one side and a tail stock 13 on the other side. The head stock 12 has a spindle 15 rotationally driven by a spindle drive unit 14 which is able to index rotational angles, e.g., a servo motor. The workpiece W is clamped by a chuck 16 of the spindle 15 at one end and is pressed by a center 17 of the tail stock 13, so as to be rotated about the C-axis corresponding to a rotational axis of the spindle 15.

In addition, the cylindrical grinding machine 1 has a CNC controller 18 to control the X-axis drive unit 8, Z-axis drive unit 6, grinding wheel drive unit 11, spindle drive unit 14 and etc. The CNC controller 18 is a computer with a CPU, ROM, RAM, hard disk drive and etc. to execute predetermined numerical control programs, so as to grind the workpiece W. Further, as shown in FIG. 1, on the head stock 12 is arranged a truing unit 25 with a truing tool 19 to true the grinding wheel 10. The truing tool 19 is a disk-like part whose circumference has a circumferential truer 19*a* and whose side has a side truer 19*b*.

Figure 2:
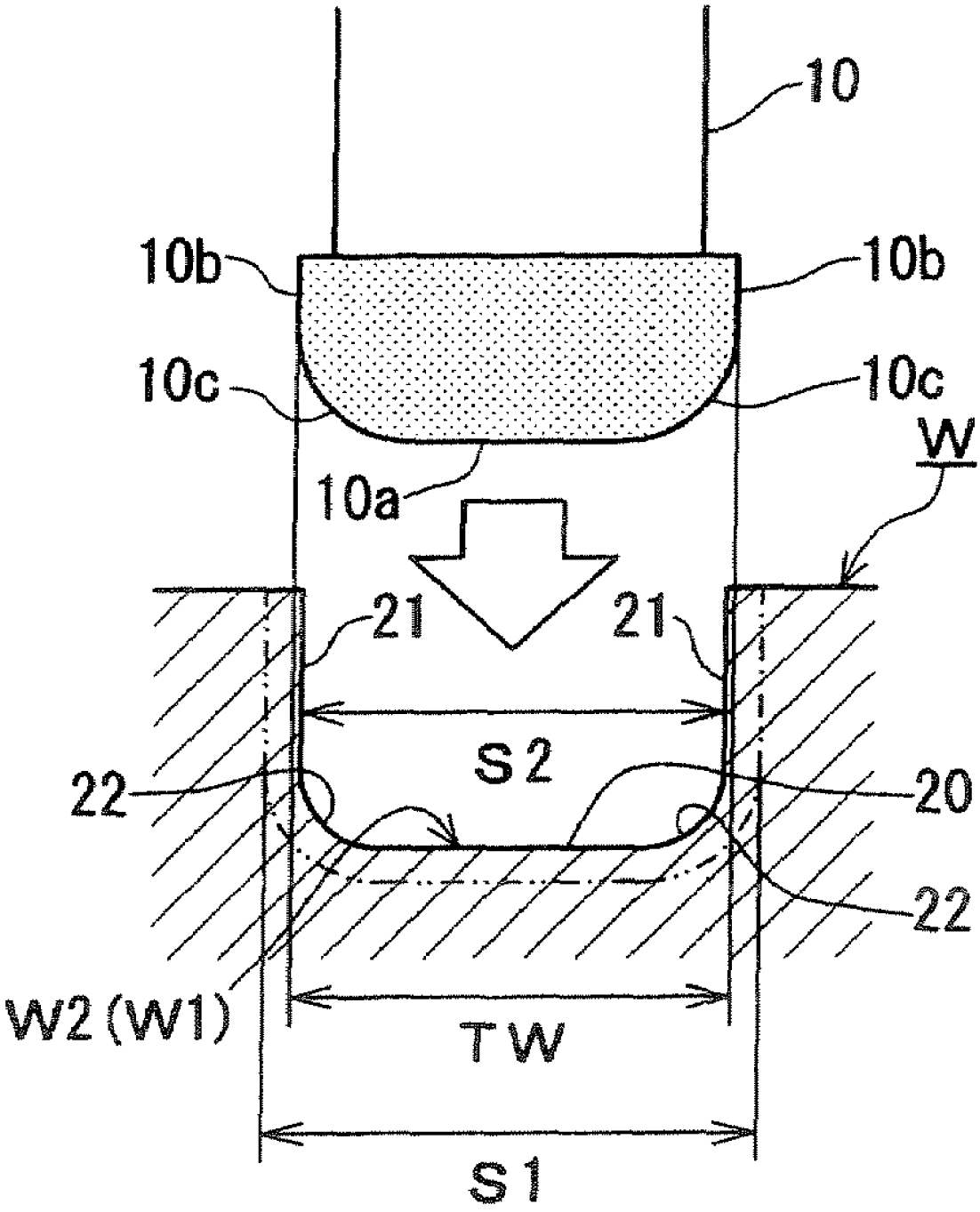
FIG. 2 is an enlarged partial section view of a workpiece and a grinding wheel of FIG. 1.

In the embodiment, the workpiece W is a crankshaft whose crank journals W1 and crank pins W2 are ground by the grinding wheel 10. The workpiece W is pre-machined by a lathing machine, milling machine or etc., so as to have an appropriate grinding allowance. FIG. 2 enlarges a region around one of the crank pins W2 or crank journals W1, and particularly shows a cylindrical part 20, a pair of end faces 21 at both sides of the cylindrical part and a pair of R-parts 22 between the cylindrical part 20 and the end faces 21. In FIG. 2, a chain double-dashed line indicates a finished shape. The grinding wheel 10 is rotatably supported about the rotational axis parallel to the C- and Z-axes and has a circumference 10*a*, a pair of sides 10*b* and a pair of curvatures 10*c*. Each of sides 10*b* is perpendicular to the circumference 10*a*. Each of the curvatures 10*c* forms a shape corresponding to each of the R-parts 22 and connects the circumference 10*a* and each of the sides 10*b*. The width TW of the grinding wheel 10 is narrower than the finished width S1 between the end faces 21 but broader than the pre-machined width S2 between the end faces 21.

Figure 3:
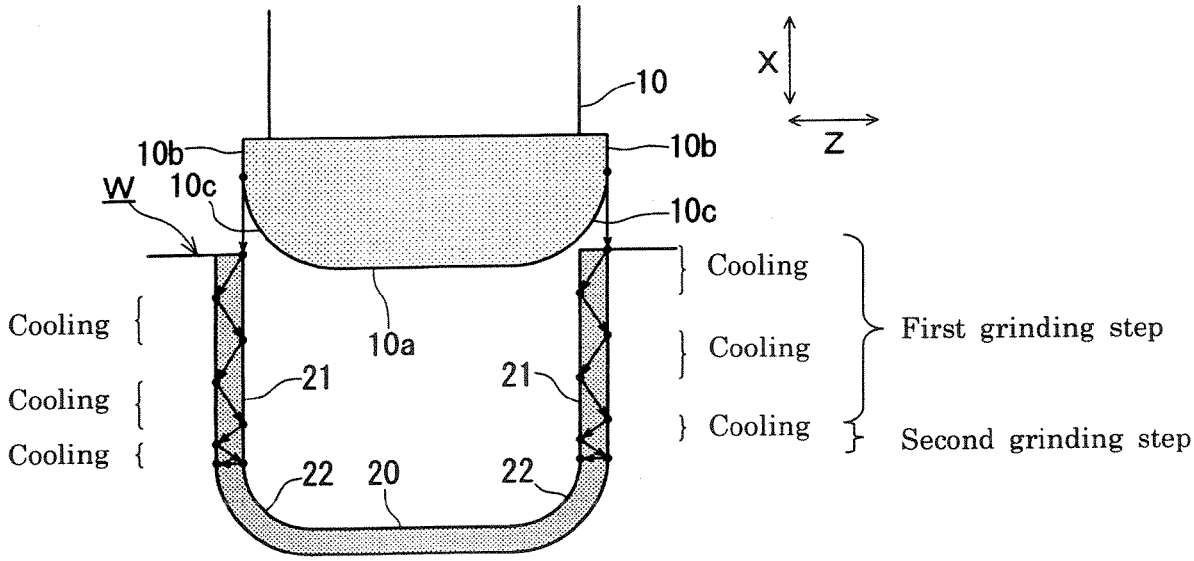
FIG. 3 is an explanatory drawing of the first embodiment, FIGS. 4(*a*) to 4(*d*) are step-by-step explanatory drawings of FIG. 3.
Figure 4:
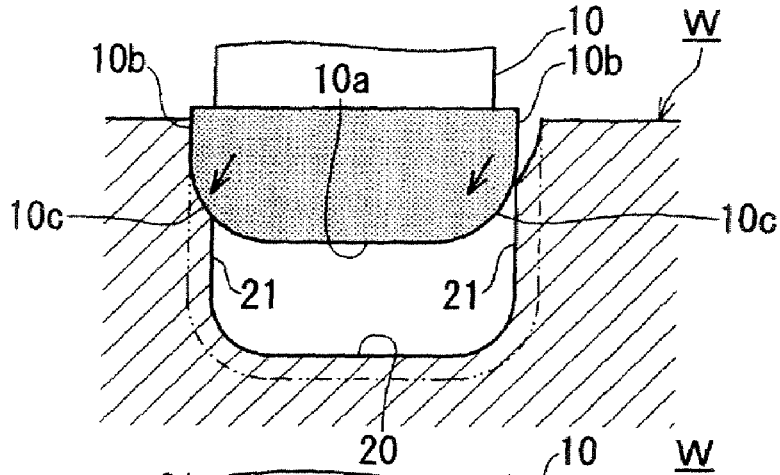
Figure 4:
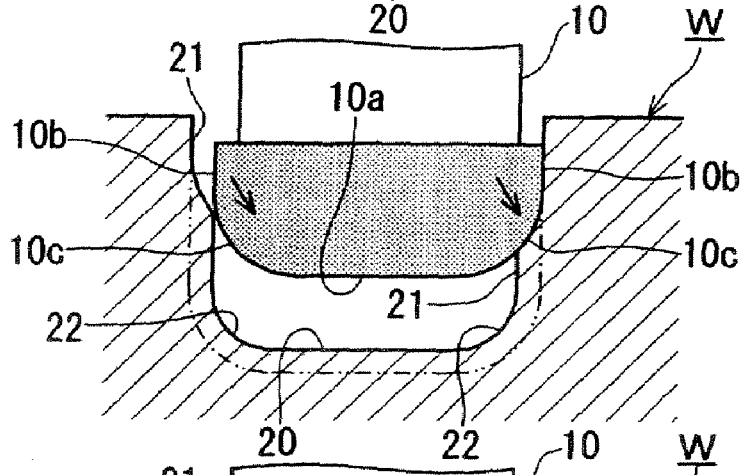
Figure 4:
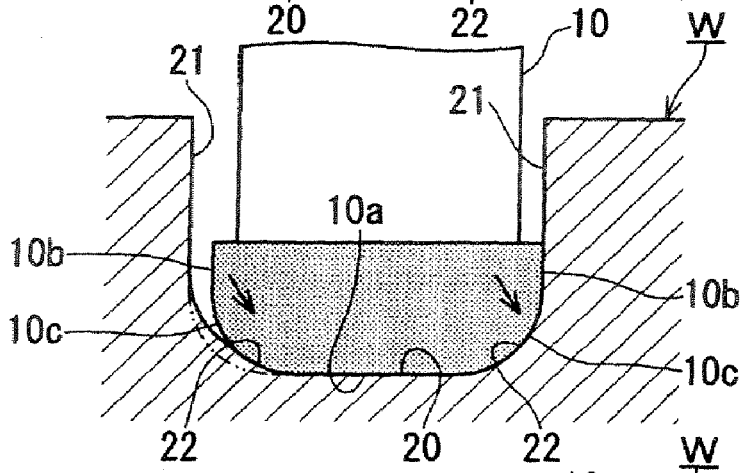
Figure 4:
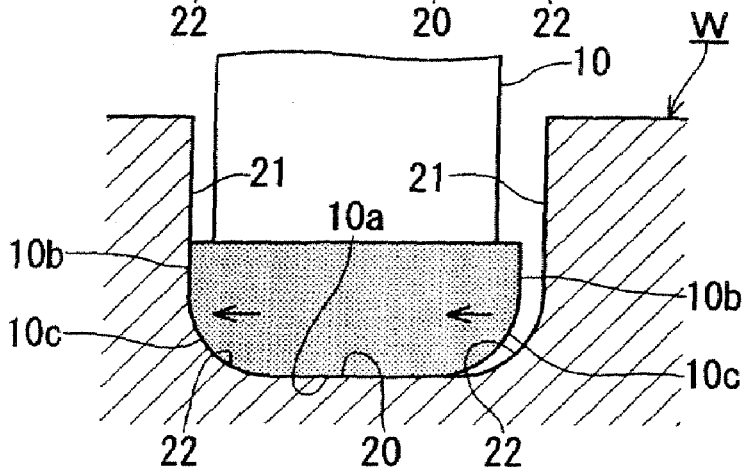

The first embodiment of a grinding method with the cylindrical grinding machine 1 will be described with reference to FIGS. 3 and 4. FIG. 3 is an explanatory drawing of the embodiment of the grinding method, and FIGS. 4(*a*) to 4(*d*) are step-by-step explanatory drawings of FIG. 3. The embodiment of the grinding method has a first grinding step and a second grinding step. In the first and second steps, the CNC controller 18 executes predetermined programs in order to control the Z-axis drive unit 6, X-axis drive unit 8 and etc., thereby the workpiece W is ground appropriately.

In the first grinding step, the grinding wheel 10 is advanced toward the rotational center of the workpiece W by the X-axis drive unit 8 and is shuttled along the axis of the workpiece W by the Z-axis drive unit 6, simultaneously. Therefore the grinding wheel 10 diagonally moves in one direction along the Z-axis for a predetermined distance to the cylindrical part 20, see FIG. 4(*a*), and then reverses to move diagonally in the other direction along the Z-axis for a predetermined distance to the cylindrical part 20, see FIG. 4(*b*). Such shuttling is done at least one time so that the grinding wheel 10 zigzags toward the cylindrical part 10. The grinding wheel 10 thereby moves to the position of the finished dimension of the cylindrical part 20, see FIG. 4(*c*). Where the grinding wheel 10 reaches the position of the finished dimension of the cylindrical part 20, one of the sides 10*b* of the grinding wheel 10 simultaneously reaches the position of the finished dimension of one of the end faces 21 of the workpiece W, so as to finish one of the end faces 21 and one of the R-parts 22.

The width TW of the grinding wheel 10 is narrower than the finished width S1 between the end faces 21 but broader than the pre-machined width S2 between the end faces 21. Thus, in the first grinding step, although the pair of the end faces 21 is simultaneously ground, zigzagging the grinding wheel 10 lets the clearance be broader between one side 10*b* of the grinding wheel 10 and one end face 21 of the workpiece W so that enough coolant is supplied into the clearance to cool the end face 21 well. Because the grinding wheel 10 alternately steps away from each of the end faces 21, each end face 21 is well cooled and prevented from the grinding burn. Thus both end faces 21 gain well-finished surfaces.

Also, in the first grinding step, where the grinding wheel 10 grinds each end face 21, the grinding wheel 10 contacts at different portions when moving backward and forward so as to be uniformly worn. Further, since the grinding wheel 10 zigzags between both end faces 21, the finished width S1 between the end faces 21 is obtained even if the width TW of the grinding wheel 10 becomes narrower by truing. (In contrast, conventional formed grinding wheel 50 needs its width to be equal to the finishing width.) Therefore, because the truing can be performed on the entire outer surface of the grind stone of the grinding wheel 10 (the circumference 10*a*, sides 10*b* and curvatures 10*c*), the amount of the truing becomes smaller so as to increase productivity of the workpieces W ground per one grinding wheel 10.

Incidentally, in the first grinding step of the embodiment, the feed speed of X-axis is about 13-25 millimeters per minute and the feed speed of Z-axis is about 1-2 millimeters per minute. And the workpiece W has a depth to the cylindrical part 20 that is about 10-15 millimeters and the grinding allowance of each end face 21 that is about 0.2-0.3 millimeters.

Next, the second grinding step takes place. After the grinding wheel 10 has reached the position of the finished dimension of the cylindrical part 20, the grinding wheel 10 is moved from the position of the finished dimension of one end face 21 to the position of the finished dimension of the other end face 21 along the axis of the workpiece W (the Z-axis) by the Z-axis drive unit 6. In the second grinding step, because the grinding wheel 10 moves along the axis of the workpiece W (the Z-axis), the grinding wheel 10 grinds the parts that have not been ground in the first grinding step. Therefore, the cylindrical part 20, the other end face 21 and the other R-part 22 of the workpiece W are finished, see FIG. 4(*d*). Additionally the space S1 between the end faces 21 is finished to a predetermined dimension. In the second grinding step, because the grinding amount is relatively small, less grinding heat is generated so as to obtain a well-finished surface without grinding burn.

The first and second steps are done for all regions of the workpiece W to be ground. The grinding wheel 10 is trued at an appropriate timing by the truing unit 25 whose circumferential truer 19*a* and side truer 19*b* respectively true up the circumference 10*a* and sides 10*b* of the grinding wheel 10. When the grinding wheel 10 is worn to a predetermined size by the truing, a brand new grinding wheel 10 replaces the old one (the worn out grinding wheel).

In the above embodiment, the grinding wheel 10 reaches the position of the finished dimension of the cylindrical part 20 and one of the end faces 21 at the same time in the first grinding step. However, that may be modified so that the side 10*b* does not reach the finished dimension of the end face 21 at the end of the first step, and the grinding wheel 10 first moves along the Z-axis to the finished dimension of the end face 21 and then moves to the finished dimension of the other end face 21 in the second grinding step.

Figure 5:
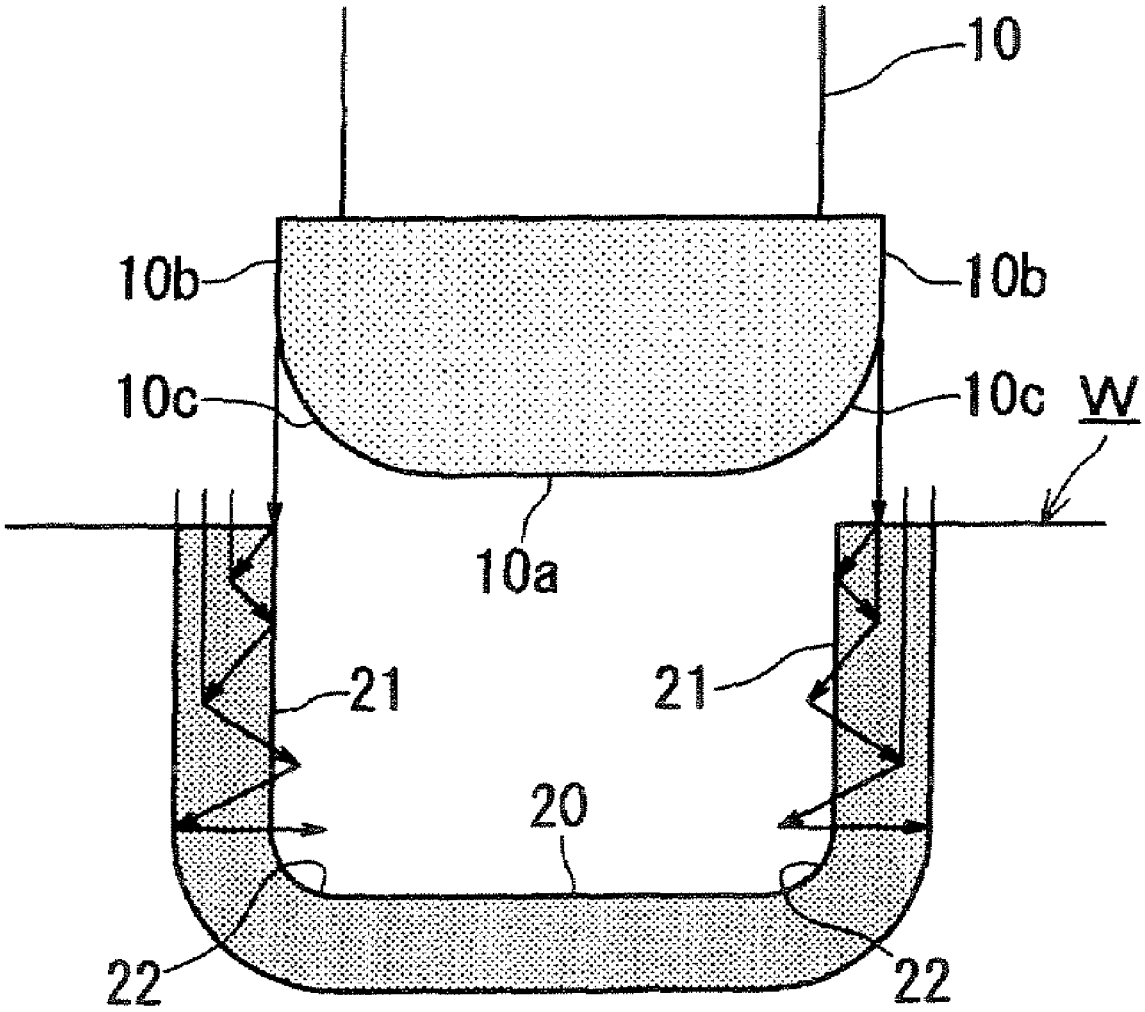
FIG. 5 is an explanatory drawing of a second embodiment, and FIGS. 6(*a*) and 6(*b*) are explanatory drawings of a conventional art.
Figure 6:
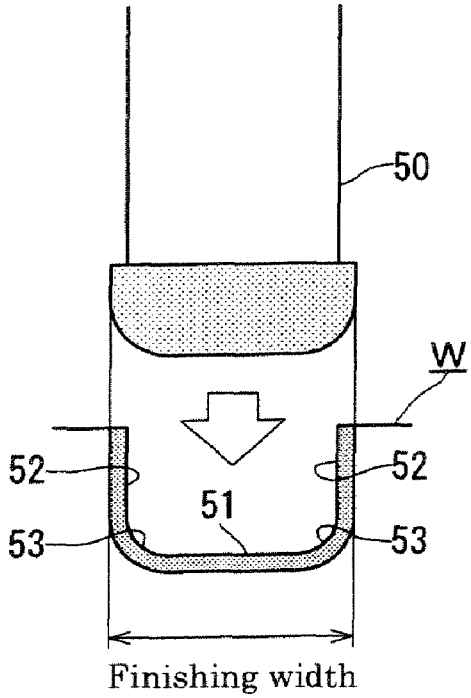
Conventional Art Fig. 6 (a)
Figure 6:
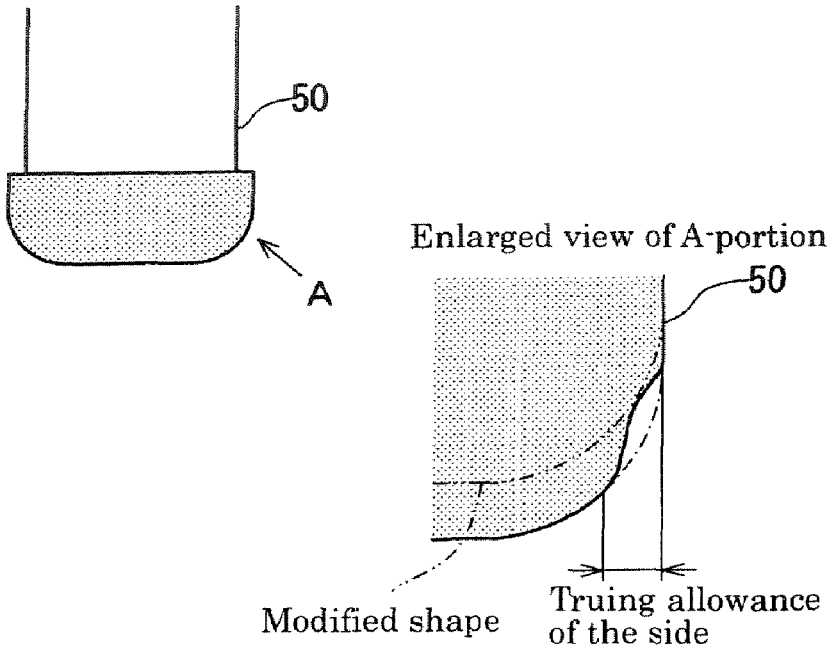
Conventional Art Fig. 6 (b)

A second embodiment of a grinding method related to the present invention will be described with reference to FIG. 5. Although in the first embodiment the shuttle width of the grinding wheel 10 is substantially constant, the shuttle width of the grinding wheel 10 gradually increases in the second embodiment as shown in FIG. 5. According to such movement, the grinding amount is relatively small in early part of the first grinding step, so as to reduce the grinding heat and its accumulation. Thus the thermal expansion of the workpiece W is reduced so that the grinding accuracy becomes higher. After the grinding wheel reaches the position of the finished dimension of the cylindrical part 20, the second grinding step takes place such that the grinding wheel 10 moves along the Z-axis as in the first embodiment. Incidentally, because the grinding wheel 10 contacts with the workpiece W in an arc as seen in the direction of Z-axis, the outer region of the end face 21 is ground to the shuttle width of the grinding wheel 10.

According to the first and second embodiments, one plunge grinding is able to complete grinding the cylindrical part 20, the end faces 21 and the R-parts 22, where each pair of end faces 21 and R-parts 22 are disposed the sides of the cylindrical part 20 and facing each other. And the grinding burn is prevented from occurring so as to obtain a well-finished surfaces. Further, the amount of truing is reduced so as to increase the productivity of workpieces W ground per one grinding wheel 10.

Obviously, numerous modifications and variations of the present invention are possible in light of the above teachings. It is thereby to be understood that within the scope of the appended claims, the present invention may be practiced otherwise than as specifically described herein.

For example, although the width TW of the grinding wheel 10 is narrower than the finished width S1 but wider than the pre-grinding width S2 between the end faces 21 in the embodiments, it is useful that the width TW of the grinding wheel 10 may be narrower than the pre-grinding width S2. This creates the same functions and effects of the embodiments. Such a width TW is able to be formed initially or after truing. And for example, any grinding machine is able to be used to grind any workpiece that has a cylindrical part and a pair of end faces disposed both sides of the cylindrical part.

What is claimed is:

1. A grinding machine for grinding a workpiece having a cylindrical part and a pair of end faces at the sides of the cylindrical part, comprising:

a grinding stone of a grinding wheel having a predetermined finishing width in a dimension between the end faces;

a head stock adapted to support the workpiece rotatably about a rotational axis;

a wheel head adapted to support the grinding wheel rotatably about a rotational axis parallel to the rotational axis of the workpiece;

drive units adapted to move the head stock and the wheel head relatively parallel to and perpendicular to the rotational axis of the workpiece; and control means for first moving the grinding wheel to the cylindrical part and simultaneously shuttling the grinding wheel at least one time between the finishing width of the end faces in a first grinding step, and for subsequently moving the grinding wheel from one of the end faces to the opposite end face on the cylindrical part in a second grinding step, wherein a shuttling width of the grinding wheel along the rotational axis of the workpiece gradually increases in the first grinding step.

2. The grinding machine according to claim 1, wherein the width of the grinding stone is broader than a pre-grinding width between the end faces.

3. The grinding machine according to claim 1, wherein the width of the grinding stone is narrower than a pre-grinding width between the end faces.

4. The grinding machine according to claim 1, wherein a pair of R-parts exists between the cylindrical part and the end faces of the workpiece and the grinding stone of the grinding wheel is formed to correspond to the R-parts; and wherein the R-parts are finished in the second grinding step.

* * * * *